US008404020B2

(12) United States Patent
Farmer et al.

(10) Patent No.: US 8,404,020 B2
(45) Date of Patent: Mar. 26, 2013

(54) SYSTEMS AND METHODS FOR MONITORING A RAPPING PROCESS

(75) Inventors: Terry Lewis Farmer, Kearney, MO (US); Vivek Badami, Schenectady, NY (US); Charles Erklin Seeley, Niskayuna, NY (US); David F. Johnston, Poquoson, VA (US); Michael M. Mahler, Hayes, VA (US); Timothy Gerald Lawrence, Newport News, VA (US)

(73) Assignee: Babcock & Wilcox Power Generation Group, Inc., Baberton, OH (US)

( * ) Notice: Subject to any disclaimer, the term of this patent is extended or adjusted under 35 U.S.C. 154(b) by 857 days.

(21) Appl. No.: 12/203,713

(22) Filed: Sep. 3, 2008

(65) Prior Publication Data

US 2010/0057269 A1 Mar. 4, 2010

(51) Int. Cl.
*B03C 3/68* (2006.01)
*B03C 3/76* (2006.01)

(52) U.S. Cl. ..... 95/2; 95/6; 95/7; 95/76; 96/18; 96/22; 96/23; 96/24; 96/32; 96/33; 323/903; 700/273; 700/275

(58) Field of Classification Search ..... 95/2, 6, 95/7, 76; 96/18, 22–24, 32–38; 323/903; 700/273, 275

See application file for complete search history.

(56) References Cited

U.S. PATENT DOCUMENTS

| | | | | | |
|---|---|---|---|---|---|
| 3,893,828 | A * | 7/1975 | Archer | 96/19 |
| 4,035,165 | A * | 7/1977 | Archer | 95/25 |
| 4,086,646 | A * | 4/1978 | Lanese | 96/25 |
| 4,255,775 | A * | 3/1981 | Andrews | 96/25 |
| 4,285,024 | A * | 8/1981 | Andrews | 96/25 |
| 5,015,267 | A * | 5/1991 | Del Gatto et al. | 95/2 |
| 5,173,867 | A | 12/1992 | Johnston et al. | |
| 5,378,978 | A * | 1/1995 | Gallo et al. | 323/241 |
| 6,540,812 | B2 | 4/2003 | Farmer et al. | |
| 2008/0000355 | A1 * | 1/2008 | Seeley et al. | 96/32 |

FOREIGN PATENT DOCUMENTS

| | | | |
|---|---|---|---|
| WO | WO 91/06371 A1 * | 5/1991 | 96/22 |

* cited by examiner

*Primary Examiner* — Richard L Chiesa
(74) *Attorney, Agent, or Firm* — Eric Marich

(57) ABSTRACT

A method for monitoring operation of a rapper in an electrostatic precipitator using a rapper control system is described. The method includes determining model electrical characteristics of the rapper. The model electrical characteristics of the rapper correspond to model mechanical operating characteristics of the rapper. The method also includes storing data corresponding to the model electrical characteristics and the model mechanical operating characteristics of the rapper, determining actual electrical characteristics of the rapper, and comparing the actual electrical characteristics of the rapper to the stored model electrical characteristics to determine actual mechanical operating characteristics of the rapper.

9 Claims, 3 Drawing Sheets

SYSTEMS AND METHODS FOR MONITORING A RAPPING PROCESS

BACKGROUND OF THE INVENTION

The field of the invention relates generally to electrostatic precipitators for use in air pollution control, and more specifically to a rapping process for use in cleaning the internal collection plates and discharge electrodes of electrostatic precipitators.

Continuous emphasis on environmental quality has resulted in increasingly strenuous regulatory controls on industrial emissions. One process for use in controlling air pollution facilitates the removal of undesirable particulate matter from a gas stream via electrostatic precipitation. Known electrostatic precipitators electrically charge and collect particulates generated in industrial processes such as those occurring in cement plants, pulp and paper mills, and utilities. For example, the particulate may be negatively charged and attracted to, and collected by, positively charged metal plates. Alternatively, the particulate may be positively charged and attracted to, and collected by, negatively charged metal plates. The cleaned process gas may then be further processed or safely discharged to the atmosphere.

During operation of an electrostatic precipitator, known collector plates, electrodes, and other precipitator internal components may be periodically cleaned to remove any dust build-up that has accumulated on the surfaces of such components. For example, a mechanical rapper can be used to facilitate cleaning of such components. Rappers are electromechanical devices that may be used to mechanically dislodge collected particulate/materials within an electrostatic precipitator (an ESP), electronic filter, or dust collector by applying direct current (DC) energization to the rapper.

Known rappers include a hammer that mechanically strikes an anvil coupled to internal components within the ESP. Striking the rapper shaft or anvil with the hammer transmits mechanical forces to these components to dislodge collected materials.

Several rapper variations exist which may be employed in the cleaning process. An electronic controller determines the sequence, intensity, and duration of rapping. Particulate dislodged from the plates falls into collection hoppers at the bottom of the precipitator. For example, one known rapper includes a cylindrical hammer or plunger and solenoid coil (also referred to herein as the rapper coil). In such rappers, the solenoid coil is energized to cause the hammer to be moved vertically to a height above the precipitator surface being cleaned. When the energization is terminated, the hammer strikes the anvil. Another known rapper includes a spring coupled behind the hammer. When the solenoid coil is energized, the hammer compresses the spring against the rapper assembly, and when the energization is terminated, the hammer strikes the anvil. In another known rapper, a spring is coupled behind the hammer. When the solenoid coil is energized the hammer is accelerated towards the anvil.

However, during operation, numerous operational problems associated with the cleaning process may be experienced. For example, excessive rapping may result in the particulate billowing from the plate into the gas stream where it may be re-entrained in the gas flow and discharged from the exhaust stack, thus increasing emissions into the atmosphere. In contrast, insufficient rapping may prevent particulate from being removed from the surfaces to be cleaned. In both situations, as collection efficiency of the precipitator is reduced, the gas volumes that can be treated by the precipitator are also reduced. In most industrial applications there is a direct correlation between precipitator capacity and production capacity. For example, significant monetary benefits may be derived from optimizing rapper efficiency.

BRIEF DESCRIPTION OF THE INVENTION

In one aspect, a method for monitoring operation of a rapper in an electrostatic precipitator using a rapper control system is provided. The method includes determining model electrical characteristics of the rapper. The model electrical characteristics of the rapper correspond to model mechanical operating characteristics of the rapper. The method also includes storing data corresponding to the model electrical characteristics and the model mechanical operating characteristics of the rapper, determining actual electrical characteristics of the rapper, and comparing the actual electrical characteristics of the rapper to the stored model electrical characteristics to determine actual mechanical operating characteristics of the rapper.

In another aspect, a system for monitoring operation of a rapper in an electrostatic precipitator is provided. The system includes a power control coupled to a power supply and to the rapper, a plurality of sensors configured to measure actual electrical characteristics of the rapper, and a processing unit coupled to the power control and to the plurality of sensors. The processing unit is programmed to store data corresponding to model electrical characteristics of the rapper and model mechanical operating characteristics that correspond to the model electrical characteristics. The processing unit is also programmed to compare the actual electrical characteristics of the rapper to the model electrical characteristics to determine actual mechanical operating characteristics of the rapper.

DETAILED DESCRIPTION OF THE INVENTION

The intensity of the rap performed by a rapper in an electrostatic precipitator (ESP), and the corresponding cleaning forces imparted to the internal components of the ESP, are determined at least in part by the height that the hammer is lifted. This is known as the rapper lift. If the hammer is not lifted high enough, then there will be insufficient cleaning. Conversely, if the hammer is lifted too high, then damage to the internal components of the ESP may result. Also, the ESP may include multiple rappers that, if operated in a manner that does not facilitate the multiple rappers to working together, may interfere with ESP efficiency. Therefore, it is desirable to closely regulate mechanical operation of a rapper to provide thorough cleaning without damage, and to control an individual rapper's performance to avoid interfering with performance of another rapper. It is an object of this invention to provide a system to closely and accurately determine and regulate mechanical operation of the rapper.

Generally, determining actual performance of a rapper in an ESP facilitates determining an efficiency of the cleaning forces imparted to internal components of the ESP. Moreover, determining actual performance of the rapper also facilitates accurate control of the operation of the rapper. In addition, accurate control of the operation of the rapper facilitates a more thorough cleaning of the components included in the ESP, with minimized damage to the components from excess rapping (e.g., more forceful raps than necessary and/or a greater number of raps than necessary). Accordingly, it is desirable to have a rapper control system that enables a user to more accurately determine the mechanical operating characteristics of the rapper and also facilitates the accurate control of the rapper based on measured electrical characteristics. For example, model electrical characteristics are stored in a memory, with corresponding model mechanical operating characteristics. In the exemplary embodiment, as described in more detail below, actual electrical characteristics are measured and compared to the model electrical characteristics. From this comparison, actual mechanical operating characteristics are determined based on the model mechanical operating characteristics that correspond to the actual electrical characteristics/model electrical characteristics.

Figure 1:
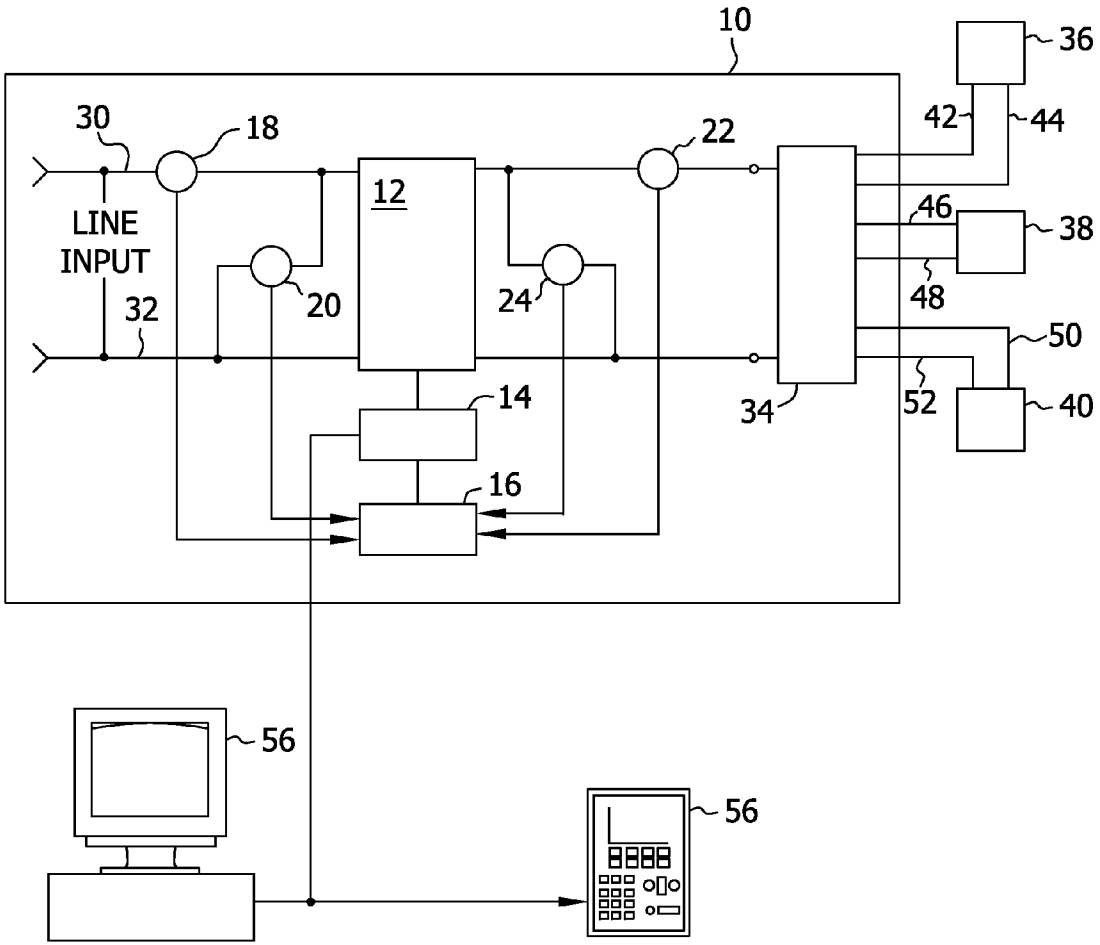
FIG. 1 is a block diagram of an exemplary rapper control system.

FIG. 1 is a block diagram of an exemplary rapper control system 10. In the exemplary embodiment, rapper control system 10 includes a power controller 12, a processing unit 14, an analog-to-digital (A/D) converter 16, and a plurality of sensors, such as, for example, a line current sensor 18, a line voltage sensor 20, a load current sensor 22, and a load voltage sensor 24. In the exemplary embodiment, a polarity reversing circuit (not shown in FIG. 1) is included within, or coupled to, power controller 12. The polarity reversing circuit (not shown in FIG. 1) facilitates reducing undesirable magnetization of rapper components.

Power controller 12 is coupled to a power source (not shown in FIG. 1), for example, via input lines 30 and 32. Power controller 12 is also coupled to at least one switch 34. The at least one switch 34 facilitates providing power and control signals from power controller 12 to at least one individual rapper, for example, rappers 36, 38, and 40. Individual rappers 36, 38, and 40 may be referred to herein as a load to power controller 12. Load lines 42, 44, 46, 48, 50, and 52 couple the at least one switch 34, and therefore power controller 12, to individual rappers 36, 38, and 40. In other words, the switches 34 are configured to couple power controller 12 to the plurality of individual rappers for powering, and control, of each individual rapper. Although described herein as powering and controlling rappers 36, 38, and 40, rapper control system 10 facilitates powering and controlling any number of individual rappers. In some embodiments, the switches 34 may include a triode for alternating current (TRIAC) switch device or a plurality of silicon controlled rectifiers (SCR). Also, in some embodiments, a power relay may perform the functions of the switches 34.

Line current sensor 18 is positioned between the power source (not shown in FIG. 1) and power controller 12 for use in measuring the line current provided to power controller 12. Line voltage sensor 20 is positioned between input line 30 and input line 32 for use in measuring the line voltage provided to power controller 12. Similarly, load current sensor 22 is positioned between power controller 12 and switches 34 for use in measuring the load current provided to each individual rapper 36, 38, and 40, and load voltage sensor 24 is positioned to measure a voltage drop at the output of power controller 12.

In the exemplary embodiment, rapper control system 10 includes processing unit 14. Processing unit 14 may include a microprocessor (not shown in FIG. 1) coupled to a memory (not shown in FIG. 1), or may be embodied in a single component, for example, a microcomputer. Processing unit 14 may also be a personal computer (PC) or any other computing device that allows system 10 to function as described herein. In the exemplary embodiment, processing unit 14 is coupled to power controller 12 and to A/D converter 16. In the exemplary embodiment, sensors 18, 20, 22, and 24 provide analog measurements (i.e., analog waveforms) to A/D converter 16. Processing unit 14 receives the digitized waveforms from A/D converter 16 and stores the digitized waveforms in the memory. Moreover, in the exemplary embodiment, the digitized waveforms are synchronized with one another, such that a relative phase difference between current and voltage waveforms are also stored in the memory.

In the exemplary embodiment, current and voltage waveforms stored in the memory are provided to a graphical display 56 that enables a user to view the waveforms generated for each rapper strike. The waveforms are an example of actual electrical characteristics of rapper 36. User graphical display 56 may be a stand-alone color oscilloscope, a monitor coupled to a computer, a panel-mounted color display, and/or any other display that enables viewing of the waveforms as described herein. In other words, the individual values of current and voltage are plotted against time for each rapper strike and displayed on graphical display 56. In addition, calculated values derived from the stored values may also be displayed.

The individual, time-referenced waveforms stored in the memory may be further acted upon by processing unit 14. For example, any property of the waveform, such as, but not limited to, its amplitude and/or duration, may be calculated by processing unit 14. More specifically, the average, peak, minimum, and/or root mean square (RMS) value of the entire waveform or any portion thereof may also be determined. The rate of rise or fall of the entire waveform or any portion thereof, may also be calculated. Such calculations may occur while, for example, rapper 36 is being fired or when it is not being fired.

In the exemplary embodiment, the above-described calculations are used to detect an internal fault condition of rapper control system 10. For example, the presence of a high line current when, for example, rapper 36 is not being fired may be an indication of an internal fault condition of rapper control system 10.

In the exemplary embodiment, the above-described calculations are also used to determine actual mechanical operating characteristics of each individual rapper 36, 38, and 40, such as, but not limited to, a lift height of the rapper hammer (not shown in FIG. 1). More specifically, a portion of the average load current energizing rapper 36 is proportional to the lift height of the rapper hammer (not shown in FIG. 1). In the exemplary embodiment, to determine the lift height of the rapper hammer, the average current of a portion of the waveform is calculated and is then compared to data stored in the memory of processing unit 14. The data stored in processing unit 14 includes a look-up table of average current in relation to lift height of a rapper hammer for a rapper (not shown in FIG. 1) that is substantially similar to the rapper 36 coupled to power controller 12.

In the exemplary embodiment, the above-described calculations are also used to qualitatively measure a condition of rapper 36 by detecting open and short conditions, as well as internal rapper faults. Furthermore, a combination of the individual time-referenced waveforms stored in memory may also be acted upon by processing unit 14. For example, multiple waveforms are compared or combined together in an equation. Actual electrical characteristics of rapper 36, such as measured power used to fire rapper 36 or measured complex impedance, including both resistive and reactive components, may then be calculated.

In the exemplary embodiment, the model electrical characteristics stored in the memory are used to determine the actual mechanical operating characteristics such as, but not limited to, rapper faults, a lift height of the rapper hammer (not shown in FIG. 1), and an efficiency of the rapper 36. As is known, in electrical circuit theory, Thevenin's theorem states that complex networks can be reduced to a Thevenin equivalent two-terminal network. Once the supply voltage and current connected to the complex network are known, and the phase shift between the voltage and current is known, a two terminal Thevenin equivalent circuit impedance can then be calculated. This impedance may be complex, and may include resistive, capacitive, and inductive components. Therefore, rapper 36 can be characterized as to the complex impedance at rest (i.e., when the rapper coil is energized, but the rapper hammer is not moving), and in operation (i.e., when the rapper coil is energized and the rapper hammer is traveling through the rapper coil). Once characterized, the complex impedances calculated during actual operation of rapper 36 are compared to known models of the complex impedances stored in the memory of processing unit 14 to determine actual mechanical operating characteristics of rapper 36, including, but not limited to, rapper faults, lift height, and efficiency.

For example, through experimentation, model electrical characteristics, such as, but not limited to, the complex impedances for a specific rapper, are measured at rest, and during operation. Model mechanical operating characteristics, such as, but not limited to, the position of the rapper, along with the corresponding measured model electrical characteristics, are stored in processing unit 14. The positions and corresponding measured complex impedance combinations are referred to herein as a rapper model. Processing unit 14 compares the complex impedances of rapper 36, measured during operation of rapper 36, to the stored models to determine actual mechanical operating characteristics of rapper 36, such as, but not limited to, rapper faults, lift heights, and efficiencies. Determining the position of each rapper 36 facilitates accurate control of, for example, the lift height of rapper 36.

In the exemplary embodiment, comparing the actual electrical characteristics measured during operation of rapper 36 to the models stored in processing unit 14 facilitates accurate and repeatable lift heights of the rapper hammer during rapper operation. In one embodiment, inferential sensing technology is used (i.e., a parameter of interest is inferred by measuring another parameter). For example, the voltage and current time histories used to energize rapper 36 are measured, such as one-hundred milliseconds (100 ms) worth of data sampled at ten kilohertz (10 kHz). The measured historical data is input to processing unit 14, which calculates the current, and then compares the calculated current to the actual measured current. In the exemplary embodiment, processing unit 14 iteratively tunes mathematical model parameters, and recalculates the predicted current to best match the measured current. Once the predicted current and the measured current are substantially matched to within a predetermined tolerance, the model parameters are used to predict a rapper plunger velocity using a previously determined correlation between the model characteristics and plunger velocity.

In the exemplary embodiment, the predicted plunger velocity may also be integrated over time to enable the plunger position and height at any point in time during operation to be determined. Additional data, such as a maximum height obtained, a time of impact, and a time of plunger travel, may also be calculated. More specifically, the mathematical model implemented in the computer program can be executed to determine the back electromotive force (EMF) due to the motion of the plunger through a magnetic field generated by the coil of rapper 36. A representative resistance of the back EMF is determined relative to plunger velocity and input in the mathematical model. In another embodiment, the position of the plunger relative to the coil is determined by measuring the inductance of the coil with respect to the position of the plunger. In both embodiments, (back EMF and inductance), the voltage measurements, current measurements, and iterative computer program described above may be utilized.

In the exemplary embodiment, an amount of power used to fire rapper 36 is determined using the following equations:

$$\text{InputPower}=\text{LineCurrent}*\text{LineVoltage}*\text{PhaseAngle} \qquad \text{Equation 1}$$

$$\text{OutputPower}=\text{LoadVoltage}*\text{LoadCurrent} \qquad \text{Equation 2}$$

The amount of power used to fire rapper 36 is used in combination with stored model parameters to determine actual rapper conditions and rapper faults.

Figure 2:
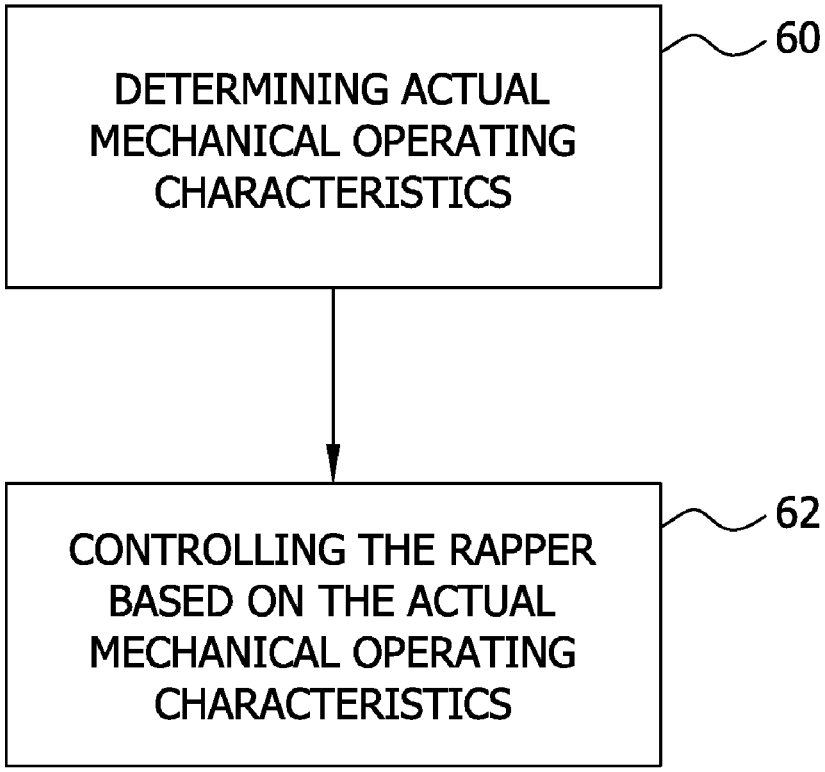
FIG. 2 is a flowchart illustrating an exemplary method for use in controlling rapping of an electrostatic precipitator.
Figure 3:
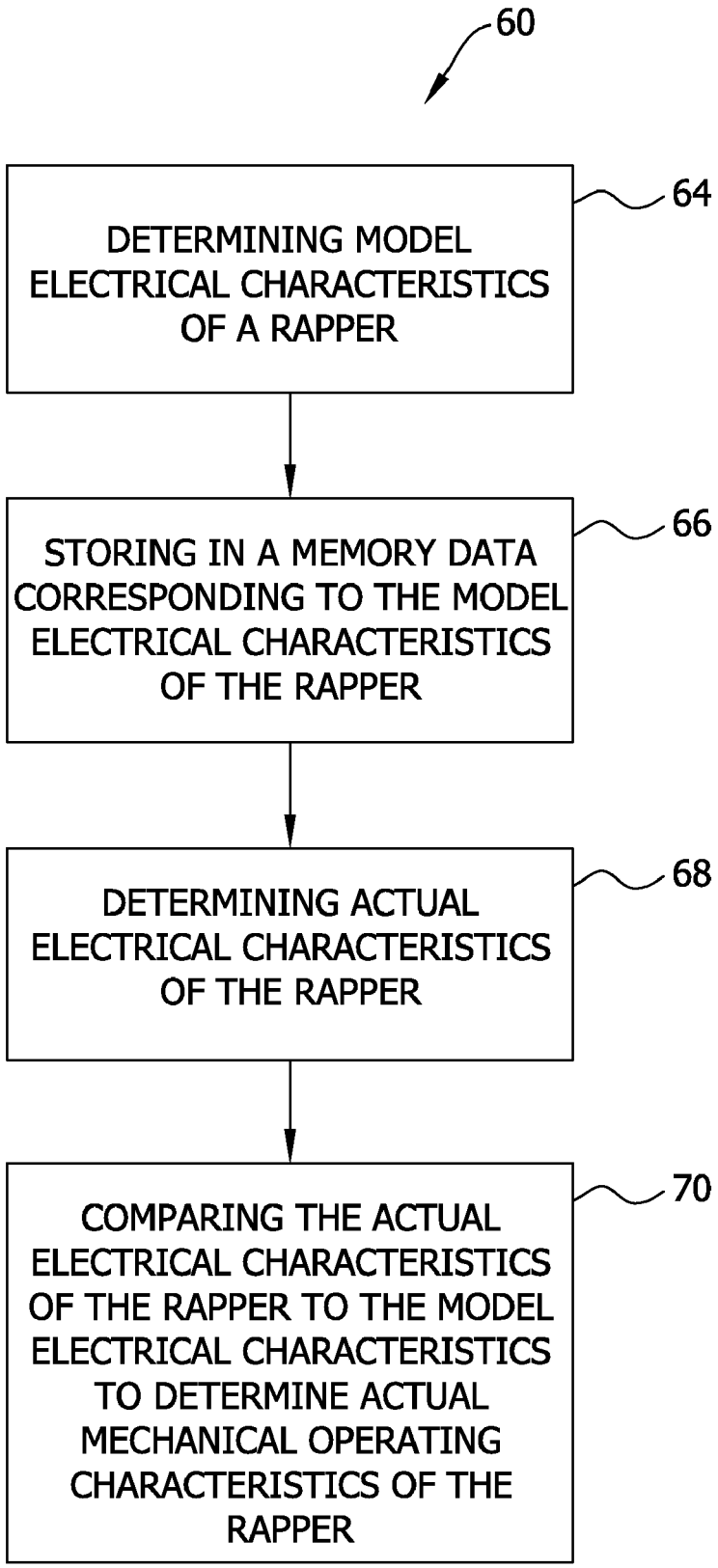
FIG. 3 is a flowchart illustrating an exemplary method for determining actual rapping characteristics.

FIG. 2 is a flowchart illustrating an exemplary method for use in monitoring the rapping of an electrostatic precipitator. FIG. 3 is a flowchart illustrating an exemplary method for determining 60 actual mechanical operating characteristics. More specifically, the method illustrated includes determining 60 actual mechanical operating characteristics (i.e., actual performance of the rapper) and controlling 62 the rapping based on this determination.

In the exemplary embodiment, the process of determining 60 actual mechanical operating characteristics of the rapper includes determining 64 model electrical characteristics of the rapper, storing 66 in a memory data corresponding to the model electrical characteristics of the rapper, determining 68 actual electrical characteristics of the rapper, and comparing 70 the actual electrical characteristics of the rapper to the model electrical characteristics stored in memory to determine actual mechanical operating characteristics of the rapper.

In the exemplary embodiment, such model electrical characteristics correspond to model mechanical operating characteristics of the rapper. As described above, such rapper 36 (shown in FIG. 1) is a load on power controller 12 (shown in FIG. 1). The electrical characteristics of the load (e.g., rapper 36) change during operation of rapper 36 (shown in FIG. 1). For example, power controller 12, during some operations, may view the load as purely inductive when the rapper hammer is at a first position and as purely capacitive when the rapper hammer is at a second position.

In the exemplary embodiment, the model electrical characteristics determined 64 may include a plurality of complex impedances of the rapper that each correspond to model mechanical operating characteristics of the rapper. For example, a resistance value, a capacitance value, and an inductance value of rapper 36 may be determined and recorded along with the corresponding model mechanical operating characteristics that produced those values.

More specifically, the model mechanical operating characteristics may include a rapper hammer lift height and a rapper hammer velocity. The model electrical characteristics of rapper 36, and corresponding model mechanical operating characteristics, may be determined through testing and/or monitoring of rapper 36. For example, a variety of different rappers may be tested, and the results recorded.

The exemplary method also includes the process of storing 66 data corresponding to the model electrical characteristics and the model mechanical operating characteristics of rappers 36, 38, and 40. In the exemplary embodiment, the model mechanical operating characteristics and corresponding model electrical characteristics of a particular rapper are stored in a memory of processing unit 14 (shown in FIG. 1), for example a microcomputer. For example, in the exemplary embodiment, the particular rapper is substantially similar to the type of rapper the rapper control system will be coupled to. In an alternative embodiment, model mechanical operating characteristics and model electrical characteristics of a plurality of different rappers are stored in the processing unit, and a user of the rapper control system is able to input to the processing unit the type of rapper that is coupled to the processing unit. In another embodiment, the processing unit is configured to automatically determine the type of rapper coupled to the processing unit and select the proper model data that corresponds to that type of rapper.

In the exemplary embodiment, the model mechanical operating characteristics may include, but are not limited to, a model velocity of a rapper plunger under a plurality of different model load resistance conditions, and a lift height of a rapper plunger. In the exemplary embodiment, such data is stored 66 in the processing unit.

The exemplary method also includes the process of determining 68 actual electrical characteristics of rappers 36, 38, and 40. In the exemplary embodiment, the process of determining 68 actual electrical characteristics of rapper 36 includes identifying at least one of an internal rapper fault condition and/or an open or short condition.

In the exemplary embodiment, the process of determining 68 actual electrical characteristics of the rapper also includes monitoring a load voltage and a load current provided to the rapper with respect to time, measuring a phase differential between the load voltage and the load current, and calculating actual electrical characteristics of the rapper from the measured phase differential. In the exemplary embodiment, sensors 22 and 24 (shown in FIG. 1) are used to measure the load voltage and load current, and are configured to provide such information to the processing unit.

The exemplary method also includes the process of comparing 70 the actual electrical characteristics of the rapper to the model electrical characteristics stored in memory to facilitate determining actual mechanical operating characteristics of the rapper. The process of determining 60 actual mechanical operating characteristics of the rapper includes determining at least one of a lift height of a rapper hammer, a rapper hammer velocity, and an efficiency of the rapper. More specifically, an actual lift height of a rapper hammer (i.e., actual mechanical operating characteristic) may be determined by identifying the model lift height (i.e., model mechanical operating characteristic) stored in the memory that corresponds to the model complex impedance (i.e., model electrical characteristic) that substantially corresponds to the measured complex impedance (i.e., actual electrical characteristic) of the rapper during operation.

In an alternative embodiment, to determine 68 actual electrical characteristics of the rapper, a load voltage and a load current provided to the rapper are monitored with respect to time. An actual back electromotive force (EMF) produced by the rapper plunger during operation of the rapper is also monitored, and the load resistance condition that causes the measured back EMF is determined. In the alternative embodiment, the actual velocity of the rapper is determined by comparing the determined load resistance condition to the model load resistance. The model velocity stored 66 in memory, that corresponds to the model load resistance determined to be substantially similar to the determined load resistance condition, will be substantially similar to the actual velocity of the rapper at the time method 60 is applied.

In an alternative embodiment, a mathematical model is used to predict the actual mechanical operating characteristics of the rapper based on actual electrical characteristics measured during operation. A time history of the voltage used to energize the rapper, V, is recorded, and the corresponding time history of the current, I, is also recorded. Values of a coil inductance, $L_{coil}$, a coil resistance, $R_{coil}$ and a wire resistance, $R_{wire}$, are known from previous measurements. A quantity $R_{EMF}$ is introduced to determine a back EMF, $V_{EMF}$, due to the motion of the rapper hammer through the rapper coil using Ohm's law.

$$V_{EMF}=I*R_{EMF} \quad \text{Equation 3}$$

$R_{EMF}$ is found by solving differential equations for a series RL circuit using the quantities mentioned above over the time period of rapper energization and iteratively improving guesses for $R_{EMF}$ until the current output from the mathematical model matches the recorded current time history from the rapper operation. The velocity of the rapper hammer, U, is then related to $R_{EMF}$ through a previously determined coefficient, $c_1$.

$$U=c_1*R_{EMF} \quad \text{Equation 4}$$

Once the rapper hammer velocity, U, is known, the trajectory of the rapper hammer may be predicted using Newton's Law of Gravitation and to precisely determine the moment of impact, even if the rapper coil is no longer energized. Knowledge of the moment of impact may be used in comparison with other rappers to adjust operating conditions so that groups of rappers strike at substantially identical times, facilitating reducing the possibility of damage to the collection plates and reducing re-entrainment of particulate in the exhaust flow, which may be caused by imprecise rapping.

In the exemplary method, controlling 62 the rapper based on the actual operating characteristics includes adjusting at least one of the load voltage and the load current such that the actual mechanical operating characteristics of the rapper substantially match predetermined characteristics. The predetermined characteristics include, but are not limited to including, a maximum rapper hammer height, a maximum rapper hammer velocity, and a maximum force exerted on the precipitator. In the exemplary embodiment, controlling 62 includes controlling multiple rappers 36, 38, and 40 (shown in FIG. 1). In certain embodiments, it is advantageous for rappers 36, 38, and 40 to strike a collection plate at substantially the same time. By striking the collection plate at the same time, the performance of one of rappers 36, 38, and 40 does not interfere with the performance of the other rappers. In some embodiments, controlling 62 rappers 36, 38, and 40 based on the actual operating characteristics includes determining when to energize each of rappers 36, 38, and 40, and with how much current to energize each of rappers 36, 38, and 40, such that rappers 36, 38, and 40 strike the collection plate at substantially the same time. The methods and systems described herein facilitate striking of collection plates at predetermined times, and are not limited to striking the collection plates at substantially the same time.

The above-described rapper control system is cost-effective and highly accurate. The rapper control system facilitates determining actual operating characteristics of a rapper, and facilitates control of the rapper based on the actual operating characteristics. As a result, the rapper control system facilitates efficient operation of the rapper, and therefore, of an electrostatic precipitator. The above-described rapper control system also facilitates efficient initial set-up of a rapper system by eliminating measurements of actual mechanical operating characteristics that are typically made during set-up. Furthermore, the above-described rapper control system facilitates monitoring of the rappers over time. Monitoring the performance of the rappers, for example, the number of lifts that the rapper has performed, facilitates increasing the information available to an operator of the ESP when determining maintenance and health of the rapper. Monitoring the performance of the rappers over time also facilitates maintaining consistent rapper performance even in light of such variables as varying electrical power provided to the rapper system and potential degradation of mechanical and electric components within the rapper system.

The above-described rapper control system includes a memory that stores data related to model electrical characteristics of a rapper and corresponding model operating characteristics of the rapper. A processing unit is configured to compare actual electrical characteristics of the rapper to stored model electrical characteristics of the rapper. Once the actual electrical characteristics of the rapper are determined, at least one corresponding actual mechanical operating characteristic may be determined.

Exemplary embodiments of systems and method for controlling operation of a rapper in an electrostatic precipitator are described above in detail. The systems and method are not limited to the specific embodiments described herein, but rather, components of systems and/or steps of the method may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for monitoring operation of a rapper in an electrostatic precipitator using a rapper control system, said method comprising:

determining model electrical characteristics of the rapper, wherein the model electrical characteristics of the rapper correspond to model mechanical operating characteristics of the rapper;

storing data corresponding to the model electrical characteristics and the model mechanical operating characteristics of the rapper;

determining actual electrical characteristics of the rapper; and comparing the actual electrical characteristics of the rapper to the stored model electrical characteristics to determine corresponding model mechanical operating characteristics of the rapper; and determining actual mechanical operating characteristics of the rapper based on the model mechanical operating characteristics that correspond to the compared actual and model electrical characteristics of the rapper.

2. A method in accordance with claim 1, wherein determining model electrical characteristics of the rapper comprises determining a plurality of complex impedances of the rapper that correspond to model mechanical operating characteristics of the rapper, wherein model mechanical operating characteristics comprise at least one of a model rapper hammer lift height and a model rapper hammer velocity.

3. A method in accordance with claim 1, wherein determining model electrical characteristics of the rapper comprises at least one of testing and monitoring a substantially similar rapper to the rapper in the electrostatic precipitator.

4. A method in accordance with claim 1, wherein determining actual mechanical operating characteristics of the rapper further comprises at least one of:

identifying a presence of at least one of an internal rapper fault condition and an open or short condition; and determining at least one of an actual lift height of a rapper hammer, an actual rapper hammer velocity, and an efficiency of the rapper.

5. A method in accordance with claim 4 further comprising determining at least one of a specific time to energize the rapper and an amount of current with which to energize the rapper to control a time when the rapper hammer strikes an electrostatic plate.

6. A method in accordance with claim 1 further comprising adjusting at least one of a load voltage and a load current to facilitate substantially matching the actual mechanical operating characteristics of the rapper with stored predetermined model mechanical operating characteristics.

7. A method in accordance with claim 1, wherein determining model electrical characteristics of the rapper comprises:

determining a model velocity of a rapper plunger under a plurality of different model load resistance conditions; and storing, in a memory, data corresponding to the model velocities and model load resistance conditions.

8. A method in accordance with claim 7, wherein determining actual electrical characteristics of the rapper comprises:

monitoring a load voltage and a load current provided to the rapper with respect to time;

measuring an actual back electromotive force (EMF) produced by the rapper plunger during operation of the rapper;

determining the load resistance condition that creates the measured back EMF; and determining the actual velocity of the rapper by comparing the determined load resistance to the model load resistance.

9. A method in accordance with claim 1, wherein determining actual electrical characteristics of the rapper comprises:

monitoring a load voltage and a load current supplied to the rapper with respect to time;

measuring a phase differential between the load voltage and the load current; and calculating actual electrical characteristics of the rapper based on the measured phase differential.

* * * * *